US011661768B2

(12) United States Patent
Scholz et al.

(10) Patent No.: US 11,661,768 B2
(45) Date of Patent: May 30, 2023

(54) MOTOR VEHICLE DOOR LOCK

(71) Applicant: Kiekert AG, Heiligenhaus (DE)

(72) Inventors: Michael Scholz, Essen (DE); Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 333 days.

(21) Appl. No.: 16/757,445

(22) PCT Filed: Oct. 16, 2018

(86) PCT No.: PCT/DE2018/100846

§ 371 (c)(1),
(2) Date: Apr. 20, 2020

(87) PCT Pub. No.: WO2019/076402

PCT Pub. Date: Apr. 25, 2019

(65) Prior Publication Data

US 2021/0189773 A1 Jun. 24, 2021

(30) Foreign Application Priority Data

Oct. 20, 2017 (DE) ..... 10 2017 124 518.9

(51) Int. Cl.
*E05B 77/12* (2014.01)
*E05B 79/12* (2014.01)
(Continued)

(52) U.S. Cl.
CPC ..... *E05B 77/12* (2013.01); *E05B 79/12* (2013.01); *E05B 79/20* (2013.01); *E05B 81/06* (2013.01);
(Continued)

(58) Field of Classification Search
CPC ..... E05B 77/02; E05B 77/12; E05B 81/06; E05B 81/30; E05B 81/14; E05B 81/16;
(Continued)

(56) References Cited

U.S. PATENT DOCUMENTS 6,062,613 A * 5/2000 Jung ..... E05B 81/82 292/216
8,757,679 B2 6/2014 Torkowski
(Continued)

FOREIGN PATENT DOCUMENTS

DE 4228233 A1 * 3/1994 ..... E05B 77/26
DE 19642698 A1 4/1998
(Continued)

OTHER PUBLICATIONS

Machine translation for DE102016104095 (Year: 2017).*
(Continued)

*Primary Examiner* — Christine M Mills
*Assistant Examiner* — Christopher F Callahan
(74) *Attorney, Agent, or Firm* — Renner, Otto, Boisselle & Sklar, LLP

(57) ABSTRACT

A motor vehicle door lock which is equipped with a locking mechanism that consists essentially of a rotary latch and a pawl. Also, at least one actuating lever chain for opening the locking mechanism in an emergency is provided. In addition, a control element which blocks the actuating lever chain indirectly or directly in normal operation and releases it in the event of an emergency, is provided. The control element is equipped with an electric motor having an output element.

19 Claims, 4 Drawing Sheets

(51) Int. Cl.

| | |
|---|---|
| ***E05B 79/20*** | (2014.01) |
| ***E05B 81/06*** | (2014.01) |
| ***E05B 81/18*** | (2014.01) |
| ***E05B 81/56*** | (2014.01) |
| ***E05B 81/64*** | (2014.01) |
| ***E05B 83/36*** | (2014.01) |
| *E05B 77/02* | (2014.01) |

(52) U.S. Cl.
CPC ..... *E05B 81/18* (2013.01); *E05B 81/56* (2013.01); *E05B 81/64* (2013.01); *E05B 83/36* (2013.01); *E05B 77/02* (2013.01)

(58) Field of Classification Search
CPC ..... E05B 81/18; E05B 81/34; E05B 81/42; E05B 81/56; E05B 81/64; E05B 81/90; E05B 79/20; Y10T 292/1047; Y10T 292/1082; Y10S 292/23

See application file for complete search history.

(56) References Cited

U.S. PATENT DOCUMENTS

| | | | | |
|---|---|---|---|---|
| 10,487,548 | B2 | 11/2019 | Beck | |
| 2015/0284977 | A1 * | 10/2015 | Barmscheidt | E05B 77/12 292/200 |

FOREIGN PATENT DOCUMENTS

| | | | | |
|---|---|---|---|---|
| DE | 202008003845 | U1 | 8/2009 | |
| DE | 202008003845 | U1 * | 9/2009 | E05B 77/12 |
| DE | 102008028256 | A1 | 12/2009 | |
| DE | 102012015596 | A1 | 2/2014 | |
| DE | 102015119443 | A1 | 6/2016 | |
| DE | 102016104095 | A1 | 9/2017 | |
| WO | WO-2017153182 | A1 * | 9/2017 | |

OTHER PUBLICATIONS

Machine translation for DE 202008003845 (Year: 2009).*
Machine translation and numbered paragraphs for WO 2017153182 (Year: 2017).*
Translation of International Search Report dated Feb. 19, 2019 for PCT/DE2018/100846.

* cited by examiner 16
17
18
15
13
3
14
10
11
12
6
1
5
4
2
7
9
19
8

MOTOR VEHICLE DOOR LOCK

FIELD OF DISCLOSURE

The invention relates to a motor vehicle door lock, comprising a locking mechanism consisting substantially of a rotary latch and a pawl, further comprising an actuating lever chain for opening the locking mechanism in an emergency, and comprising a control element, which blocks the actuating lever chain indirectly or directly in normal operation and releases it in the event of an emergency.

BACKGROUND OF DISCLOSURE

In the case of motor vehicle door locks which are known in the art, in conjunction with, for example, a so-called "keyless entry access," the procedure is such that when an authorized user approaches, without active intervention the motor vehicle door lock in question unlocks and the associated motor vehicle door is opened automatically. This can also take place by means of a remote control. In order to achieve this, in detail, the relevant motor vehicle door locks are equipped with an electromotive drive for so-called "electric opening." The drive ensures that, after action upon it, the pawl which was previously in engagement with the rotary latch in the closed position is lifted off from this and consequently the rotary latch can open with spring assistance. A closing bolt trapped by the rotary latch is released. The same applies to the associated motor vehicle door.

In addition to a drive for electric opening in the described normal operation, as a rule an actuating lever chain for opening the locking mechanism in an emergency can be additionally provided. In this way the motor vehicle door can also be opened when, for example, the electromotive drive can electrically open the locking mechanism as described due to discharging of the battery or a defect. In particular, such a malfunction is observed when an accident or a crash occurs. In order, in this case, nevertheless to gain access to the motor vehicle, the additional actuating lever chain is used for opening the locking mechanism in an emergency.

In this connection, the generic prior art according to DE 10 2015 119 443 A1 provides a door handle with a removable cover element for covering a lock cylinder. Moreover, a tension means is connected to the cover element in order to be able to operate a motor vehicle door lock by pulling on the cover element. In addition, a triggering device for the cover element is provided, in order to transfer this element into an open position automatically in an emergency situation.

The known triggering device or the actuating element in the terminology of the present application has a locking element for the cover element in the form of a clamp, ratchet or clip element. In addition, the triggering device has a triggering means. In the event of an accident the triggering means acts on the cover element in order to transfer this element into the open position and to transfer the locking element into a release position.

The triggering means operates automatically and in the present case is designed in the form of a shape memory alloy element. An electric magnet or a piezoelectric element can also be provided in this connection. Furthermore, the triggering device is coupled to a crash sensor.

The prior art has proven itself in principle, but is not free from defects. Thus, shape memory alloys, just like permanent magnets or electric magnets or piezoelectric elements, do not operate with permanent reliability as triggering means at all times and in all circumstances. For example, the functional reliability of such triggering means cannot always be guaranteed at extreme temperatures of down to −40° C. or up to +60° C. or 70° C.

In addition, such triggering means are subject to more or less distinct signs of aging, so that permanent functional reliability over years or decades cannot be guaranteed. Lastly, the production price for such triggering means also does not favor their widespread use, so that in the past the known motor vehicle door lock could not actually become established in practice. The invention seeks to create a remedy here.

SUMMARY OF DISCLOSURE

The technical problem underlying the invention is to further develop such a motor vehicle door lock so that reliable and lasting operation together with increased functional reliability is guaranteed at the same time as reduced costs.

In order to solve this technical problem, a generic motor vehicle locking device within the scope of the invention is characterized in that the control element is equipped with an electric motor having an output element.

Within the context of the invention the control element with the electric motor with output element has a conventional construction and involves components already in use in their millions. The output element is preferably a worm gear which meshes with the electric motor. Such electric motors and worm gears driven rotationally thereby have been used for years or decades in motor vehicle door locks, in order to assume different functions, such as for example a (central) locking function, an anti-theft function, a child-proof lock, electric opening or other functions. In other words, both the electric motor and the worm gear which meshes therewith or the output element have frequently proven themselves and are available with extremely low production costs. As a consequence of this, an increased functional reliability and long service life may be expected.

The electric motor is generally controlled as a function of signals from a sensor, in particular a crash sensor. In other words, depending upon the signal from the sensor a distinction is usually made between the normal operation and the operation for opening of the locking mechanism in an emergency. For example, a voltage of an accumulator or a vehicle battery which is too low can be determined with the aid of the sensor. As soon as a specific threshold value is undershot at this point, this ensures that the electric motor is activated and consequently the actuating lever chain, which was previously blocked in normal operation, is released for emergency opening.

Likewise, the sensor can advantageously be a crash sensor. In the simplest case, the crash sensor records excessive vehicle decelerations and the signal emitted by the crash sensor in this connection again ensures that the electric motor as component of the control element is activated. In this way it is possible in turn to change from the normal operating mode into the emergency opening mode, by the activated electric motor or the control element releasing the actuating lever chain, which was previously blocked in normal operation, opening in an emergency. In principle, of course, other sensors or combinations of a sensor for measuring the output voltage of the vehicle battery in conjunction with the crash sensor are conceivable and are covered by the invention.

In detail, the control element is designed so that it interacts directly with a lever of the actuating lever chain. In other words, in the normal operating mode the control element or the electric motor in conjunction with the output element ensures that the relevant lever of the actuating lever chain is blocked. Naturally, this then also applies to the actuating lever chain as a whole. However, with regard to the emergency operating mode the control element releases the relevant lever of the actuating lever chain, so that the actuating lever chain can be acted upon manually. As a result, by means of the manual action upon the actuating lever chain the locking mechanism can at least be opened, or opened in emergency mode.

However, it is also possible that the control element interacts indirectly with the actuating lever chain. For this, a flexible connecting element for coupling the actuating lever chain to a handle is selectively blocked/released. In other words, by means of the handle and the interposed flexible connecting element to the actuating lever chain, the actuating lever chain can be acted upon manually. According to the invention, however, this is only possible in the emergency opening mode; during the normal operation the actuating lever chain and consequently also the handle is blocked.

The indirect interaction of the control element with the actuating lever chain now means, within the context of the invention, that it is not the actuating lever chain which is directly blocked/released, but rather the flexible connecting element for coupling the actuating lever chain to the handle. In other words, the flexible connecting element undergoes blocking in normal operation and is released for emergency opening. As a result, the actuating lever chain is automatically blocked in normal operation and released for emergency opening.

The control element is preferably arranged in the interior of a lock housing. As a result the actuating element can be permanently protected against any environmental influences. The actuating lever chain is generally designed as an outer actuating lever, since actuation from the exterior is necessary for emergency opening of the motor vehicle door lock.

Accordingly, the handle already referred to previously, as an outer handle, is generally designed as an outer door handle. In principle according to the invention the In normal operation the outer door handle is blocked by means of the actuating element. Consequently, the associated motor vehicle door and thus the motor vehicle door lock can be opened exclusively electrically in normal operation. On the other hand, in emergency opening mode, the control element releases the actuating lever chain indirectly or directly and consequently the outer door handle is also released and can be acted upon by a user.

A particularly compact embodiment is characterized in that the actuating element is arranged in the region of an outer actuating lever as a component of the outer actuating lever chain. For this purpose the output element or worm gear generally has a blocking contour. The blocking contour can interact directly with the aforementioned outer actuating lever of the outer actuating lever chain. The outer actuating lever generally has an abutment surface for interaction with the blocking contour of the worm gear.

Consequently, in normal operation the blocking contour of the worm gear abuts the abutment surface of the outer actuating lever. Consequently, in the exemplary case the outer actuating lever cannot be deflected by means of the flexible connecting element connected to the outer actuating lever and when acted upon by the outer door handle. Accordingly, the outer actuating lever, the flexible connecting element and consequently also the outer door handle are blocked overall in normal operation.

For changing from normal operation to emergency opening it is merely necessary that the blocking contour on the worm gear leaves the abutment surface on the outer actuating lever. For this purpose the electric motor is correspondingly activated as soon as the signal from the sensor is present. Consequently, the outer actuating lever can be pivoted freely by means of the flexible connecting element and the actuation of the outer door handle is not blocked (any longer). The direct blocking of the outer actuating lever and consequently the actuating lever chain overall by means of the actuating element corresponds to this situation.

Within the context of the invention an indirect blocking of the actuating lever chain using the actuating element in normal operation and the release for emergency opening is also possible and conceivable. For this purpose the outer actuating lever has a connected connector element for coupling to the flexible connecting element. The connector element is usually connected by articulation to the outer actuating lever. In normal operation the worm gear now ensures that the relevant connector element is blocked. For this purpose the worm gear is moved so that its blocking contour abuts the connector element and suppresses pivoting of the outer actuating lever. Consequently, the outer actuating lever, just like the flexible connecting element and the outer door handle at the end of the connecting element, also undergoes the required blocking.

For release of the actuating lever chain or the outer actuating lever it is merely necessary that the worm gear with its blocking contour is moved away from its abutment on the connector element or is pivoted in this respect. As a result the connecting element comes free. The same applies to the outer door handle and the actuating lever chain. Consequently, in this case the actuating lever chain is blocked indirectly in normal operation and released for emergency opening.

As a result a motor vehicle door lock is provided, which is equipped with a well proven, simply structured control element which is cost-effective and functionally reliable. For this purpose the control element has an electric motor and an output element which is advantageously designed as a worm gear. The activation of the electric motor and the change from normal operation to emergency opening takes place as a function of signals from a sensor. This is advantageously a crash sensor. The essential advantages can be seen here.

BRIEF DESCRIPTION OF DRAWINGS

The invention is explained in greater detail below with reference to drawings which show two exemplary embodiments. In the drawings.

DETAILED DESCRIPTION

Figure 1:
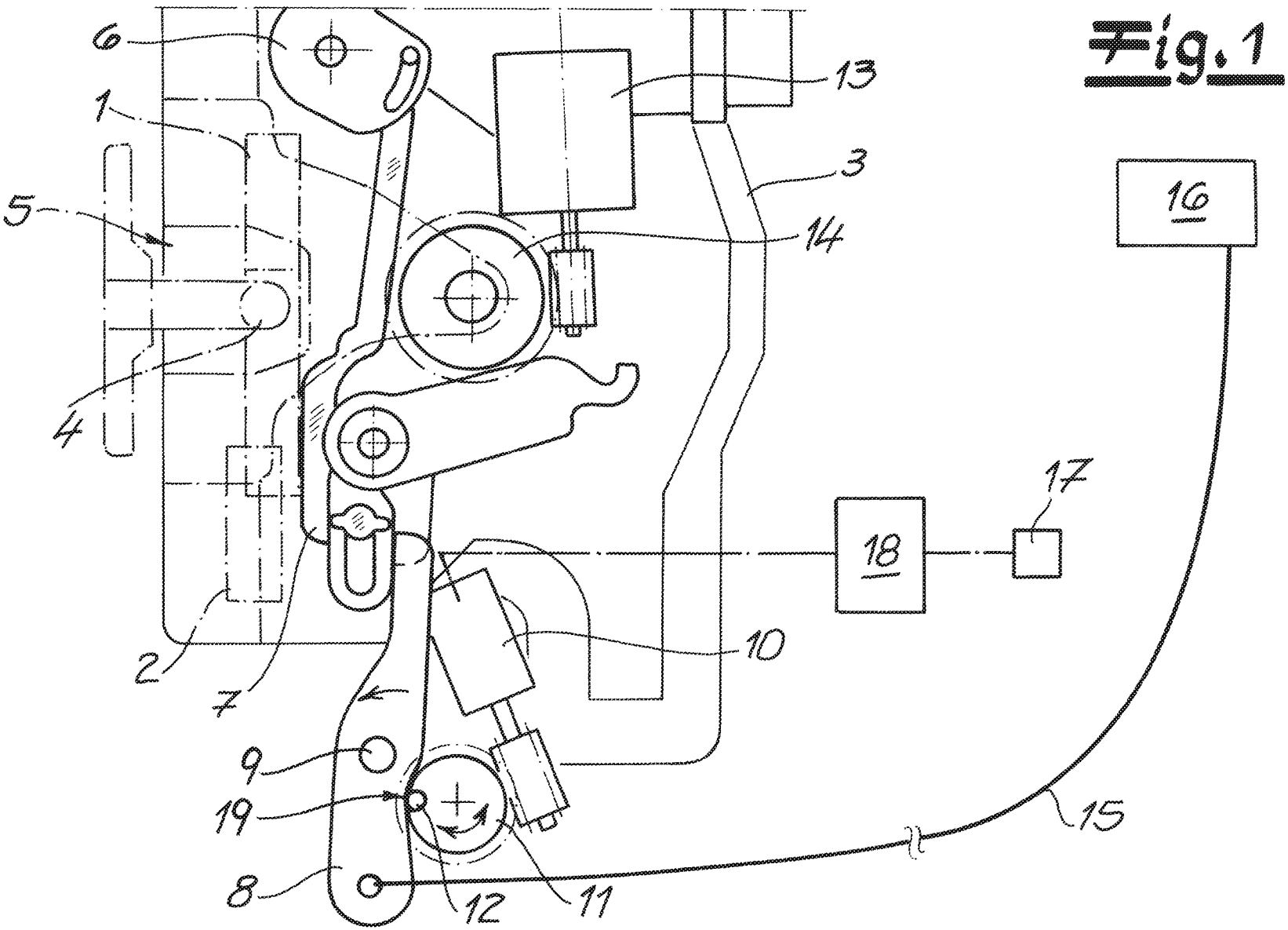
FIG. 1 shows a motor vehicle door lock according to the invention in a first design variant in normal operation.

The drawings show a motor vehicle door lock which has a locking mechanism 1, 2, merely indicated schematically in FIG. 1, which comprises at least a rotary latch 1 and a pawl 2. The locking mechanism 1, 2 in the interior of the motor vehicle door lock or in the interior of a lock housing 3 interacts with a body-side closing bolt or striker 4, as is indicated in the drawings and as has been sufficiently described previously in the prior art. For this purpose the closing bolt 4 moves into an inlet opening 5 in the lock housing 3, in order to be able to interact with the rotary latch 1. In the respective FIGS. 1 to 4 the relevant locking mechanism 1, 2 is shown in the closed state with locking bolt or striker 4 moved in.

Furthermore, a locking drive 6 is shown, which acts upon a coupling element 7. The coupling element 7, in combination with an actuating lever or outer actuating lever 8 and a triggering lever (not shown in greater detail), defines an actuating lever chain 7, 8. The outer actuating lever 8 can be pivoted about its axis 9. In this case a pivoting movement of the actuating lever or outer actuating lever 8 about the relevant axis 9 in the counter-clockwise direction indicated in FIG. 1 corresponds to the actuating lever or outer actuating lever 8 acting on the triggering lever, which for its part lifts the pawl 2 from its engagement with the rotary latch 1. In other words, in the present case the described counter-clockwise movement of the outer actuating lever 8 leads to the so-called emergency opening of the locking mechanism 1, 2.

In normal operation such emergency opening of the locking mechanism 1, 2 is not possible, because in this case a control element 10, 11, 12 directly blocks the actuating lever chain 7, 8 or, in the illustrated exemplary embodiment in FIG. 1, the outer actuating lever 8. Consequently, in normal operation the locking mechanism 1, 2 cannot be opened mechanically with the aid of the actuating lever chain 7, 8. Rather, the locking mechanism 1, 2 is opened by electric motor power. For this purpose an indicated control drive 13, 14 is provided, which serves as an opening drive for electrically opening the locking mechanism 1, 2.

The control drive or opening drive 13, 14 for electrically opening the locking mechanism 1, 2 has an electric motor 13 and an output element 14, which is a worm gear 14, which meshes with the electric motor 13. Rotary movements of the worm gear 14 in normal operation and for opening of the locking mechanism 1, 2 are transmitted indirectly or directly to the triggering lever, which consequently the lifts the pawl 2 from its engagement with the rotary latch 1. For example, the control drive 13, 14 for electrically opening the locking mechanism 1, 2 can be constructed and can operate as described in detail in DE 10 2008 028 256 A1 in the name of the applicant.

Consequently, in normal operation the control drive 13, 14 ensures the opening of the locking mechanism 1, 2 by electric motor power. In this case the actuating lever chain 7, 8 is blocked, specifically with the aid of the control element 10, 11, 12. On the other hand, if emergency opening of the locking mechanism 1, 2 is necessary, the control element 10, 11, 12 releases the actuating lever chain 7, 8. Thus in this case the locking mechanism 1, 2 can also be opened without operation of the control drive 13, 14. In the event of a crash it may be assumed that the electrical power supply of the electric motor 13 fails. Therefore in the emergency opening mode the locking mechanism 1, 2 can be opened by means of a flexible connecting element 15 in combination with a handle 16, which is an outer handle or an outer door handle 16.

The distinction between the normal operating and the emergency opening mode is made as a function of signals from a sensor 17. The signals from the sensor 17, which is merely indicated in FIG. 1, are evaluated by a control unit 18. The actuating element 10, 11, 12 is acted upon by means of the control unit 18. For this purpose the control unit 18 is connected to an electric motor 10 as component of the control element 10, 11, 12.

In addition to the electric motor 10, the control element 10, 11, 12 also has an output element 11. Moreover, the output element 11 is equipped with a blocking contour 12. The output element 11 meshes with a worm on an output shaft of the electric motor 10, so that the output element 11 is configured as a worm gear 11 in the present case. Consequently, the output element or worm gear 11 can carry out pivoting movements indicated in FIG. 1 about a central axis in a clockwise direction and a counterclockwise direction.

Figure 2:
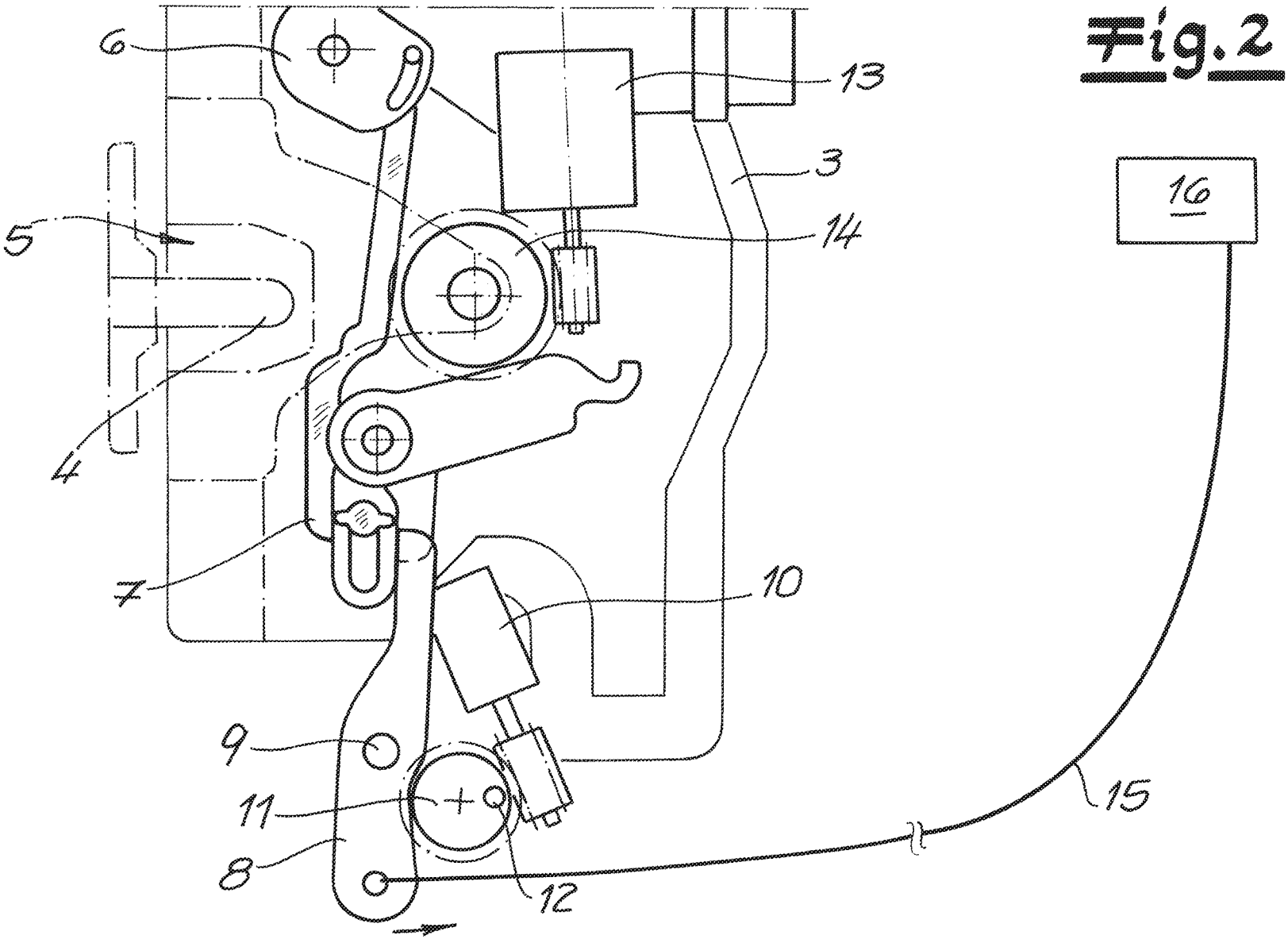
FIG. 2 shows the subject according to FIG. 1 in emergency opening mode.

Depending upon the position of the blocking contour 12 by comparison with the outer actuating lever 8, the blocking contour 12 abuts an abutment surface 19 of the outer actuating lever 8. In this case the outer actuating lever 8 cannot be pivoted about its axis 9, as illustrated in FIG. 1. On the other hand, the functional position in FIG. 2 corresponds to the control element 10, 11, 12 releasing the actuating lever chain 7, 8 for emergency opening of the locking mechanism 1, 2. In the functional position according to FIG. 2 the abutment surface 19 of the outer actuating lever 8 is released by the blocking contour 12 as a component of the control element 10, 11, 12, so that the outer actuating lever 8 can carry out the counter-clockwise movement about its axis 9 as indicated in FIG. 2. For this, it is merely necessary that the outer door handle 16 is acted upon manually.

Consequently, the flexible connecting element 15 also undergoes a corresponding deflection, which is transmitted to the outer actuating lever 8, so that this lever is pivoted about its axis 9 in the counterclockwise direction as indicated in FIG. 2. In this way the outer actuating lever 8 can act on the triggering lever (not shown), which for its part lifts the pawl 2 from its engagement with the rotary latch 1. The locking bolt or striker 4 comes free from its engagement with the locking mechanism 1, 2. The motor vehicle door lock and the associated motor vehicle door are opened or can be opened.

The mode of operation is as follows. FIGS. 1 and 2 show a first embodiment of the motor vehicle door lock according to the invention. This first embodiment is characterized in that the control element 10, 11, 12 there directly blocks the actuating lever chain 7, 8 in normal operation, as FIG. 1 shows. In normal operation the aforementioned blocking contour 12 of the worm gear 11 abuts the abutment surface 19 of the outer actuating lever 8. If in the functional position according to FIG. 1 the outer door handle 16 is acted upon manually and as a result the flexible connecting means 15 is deflected, this action of force is not converted into a pivoting movement of the outer actuating lever 8 about its axis 9. The counterclockwise pivoting movement of the outer actuating lever 8 indicated in FIG. 1 is blocked by the control element 10, 11, 12. This corresponds to normal operation.

In other words, in normal operation corresponding to the representation in FIG. 1 in the first embodiment the locking mechanism 1, 2 there can be opened merely by electric motor powered with the aid of the control drive 13, 14—as previously already described. However if emergency operation and an emergency opening of the locking mechanism 1, 2 becomes necessary, a corresponding signal of the sensor 17 corresponds to this situation. The sensor 17 is advantageously a crash sensor. In other words, the sensor 17 can also be designed as a deceleration sensor or basically also as a voltage sensor, by means of which a crash or generally the lowering of an operating voltage of the motor vehicle body is detected. The corresponding signal from the sensor 17 is processed by the control unit 18. If the control unit 18 recognizes an emergency operation or a necessary emergency opening of the locking mechanism 1, 2, the control unit 18 acts upon the electric motor 10 as a component of the actuating element 10, 11, 12.

In this case the electric motor 10 is supplied with current in such a way that the control element 10, 11, 12 moves from its position shown in FIG. 1 into the functional position according to FIG. 2. Consequently, starting from the functional position in FIG. 1, the output element or worm gear 11 carries out a movement about its central axis in the counterclockwise direction by approximately 180°. This corresponds to the position in FIG. 2.

Since in the example the worm gear 11 is arranged in a plane below the outer actuating lever 8, by action on the outer door handle 16 in the functional position according to FIG. 2 the outer actuating lever 8 can be pivoted in the counter-clockwise direction about its axis 9 by means of the intermediate flexible connecting element 15, as indicated by the arrow in FIG. 2. As a result, in the described exemplary case emergency opening of the locking mechanism 1, 2 is possible.

Figure 3:
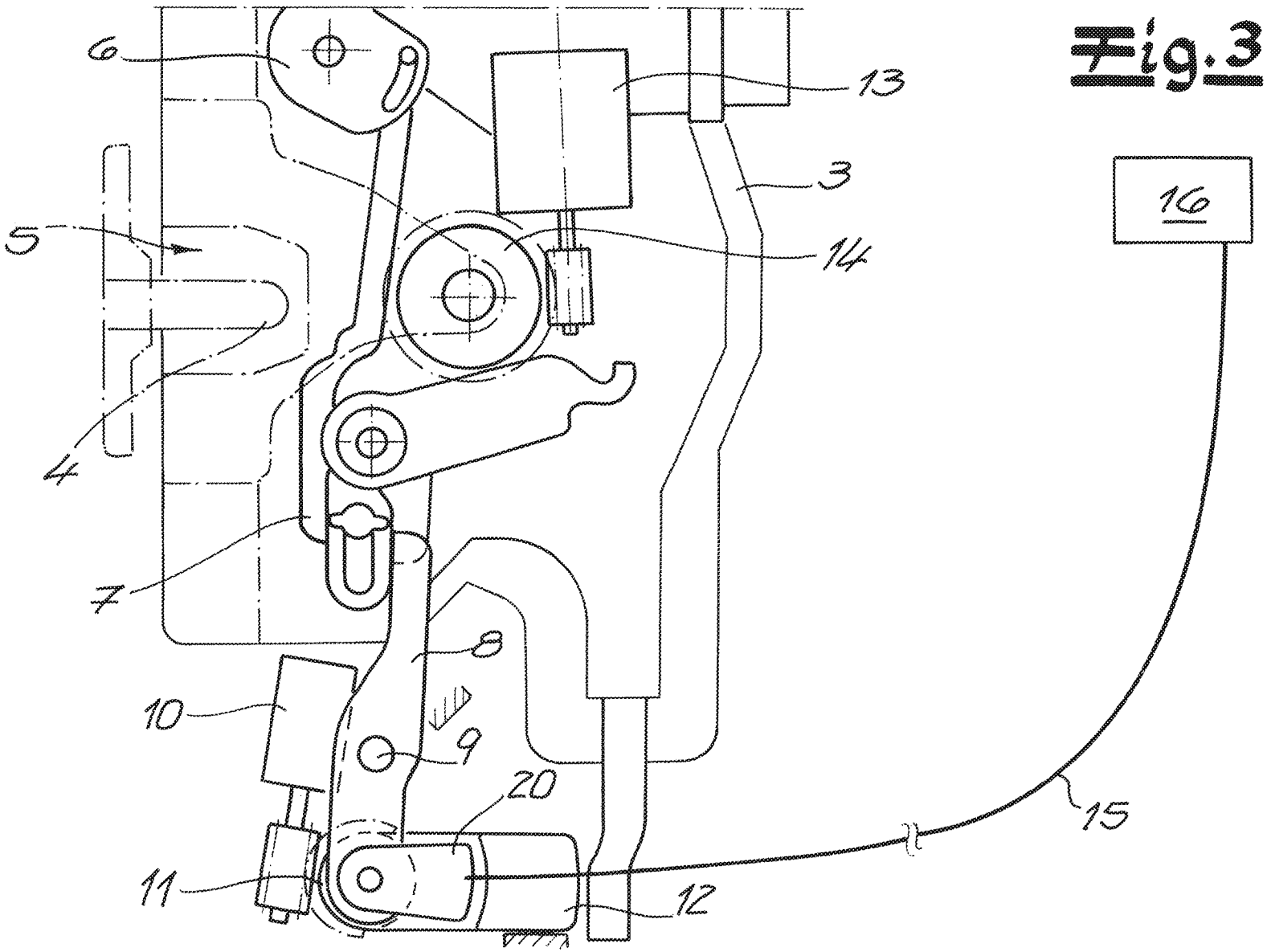
FIG. 3 shows a motor vehicle door lock according to the invention in a second variant in normal operation.
Figure 4:
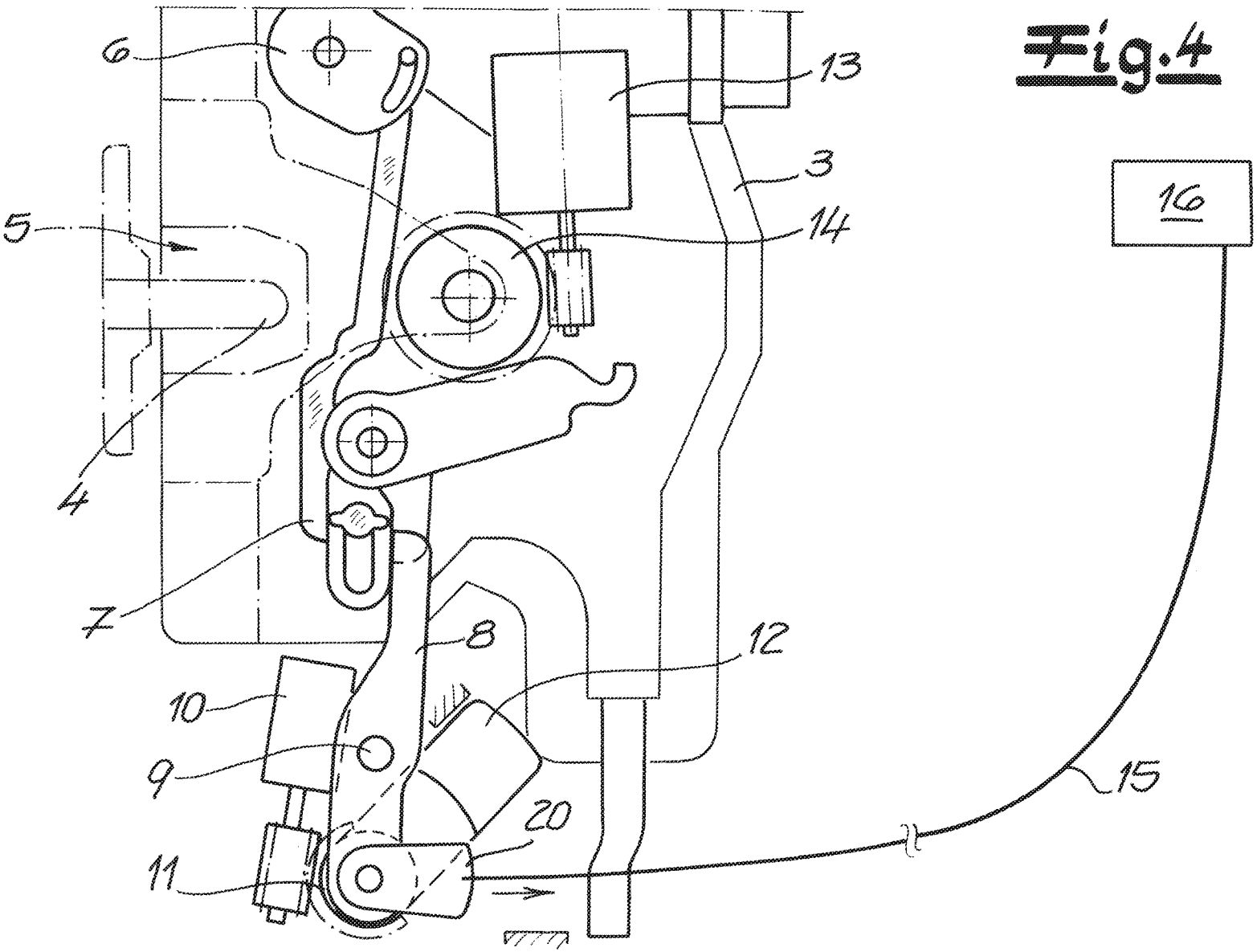
FIG. 4 shows the subject according to FIG. 3 in emergency opening mode.

FIGS. 3 and 4 show another exemplary embodiment of the invention. In this case, the control element 10, 11, 12 ensures that the actuating lever chain 7, 8 is blocked indirectly in normal operation. Normal operation corresponds to the functional position in FIG. 3. It will be recognized that in this case the outer actuating lever 8 has a connected connector element 20. The connector element 20 is articulated on an end of the outer actuating lever 8 remote from the axis. Moreover, the connector element 20 ensures the connection of the flexible connecting element 15. By action upon the outer door handle 16 in normal operation corresponding to the representation in FIG. 3, the outer actuating lever 8 in turn cannot be pivoted about its axis 9.

Such pivoting movements of the outer actuating lever 8 about its axis 9 are blocked by the worm gear 11 of the actuating element 10, 11, 12 coming into abutment with its blocking contour 12 on the connector element 20 or blocking the connector element 20. This corresponds to normal operation. In other words, in the functional position according to FIG. 3 the locking mechanism 1, 2 can again be opened merely by electric motor power by means of the electric opening drive or control drive 13, 14.

If an emergency or crash occurs and emergency opening of the locking mechanism 1, 2 becomes necessary, the signal from the sensor 17 is again evaluated by means of the control unit 18. The control unit 18 acts upon the electric motor 10 in such a way that the worm gear 11 and, with it, the blocking contour 12 carries out a pivoting movement in the counterclockwise direction about approximately 45° starting from the functional position in FIG. 3. This can be recognized in the transition from FIG. 3 to FIG. 4. Consequently the connector element 20 articulated on the outer actuating lever 8 comes free from the blocking contour 12. Action on the outer door handle 16 now leads directly by means of the interposed flexible connecting element 15 to the outer actuating lever 8 being pivoted in the counterclockwise direction about its axis 9 and in this way the pawl 2 lifts off from its engagement with the rotary latch 1 by means of the interposed triggering lever. Emergency opening of the locking mechanism 1, 2 takes place.

A common feature of both embodiments is that the control element 10, 11, 12 in each case is arranged in the interior of the lock housing 3. Moreover, it will be recognized that in the present case the actuating lever chain 7, 8 is designed as an outer actuating lever. The actuating lever chain 7, 8 is coupled mechanically to the outer door handle 16 or an outer handle. Moreover, the outer actuating lever 8 is configured as a component of the relevant outer actuating lever chain or actuating lever chain 7, 8. In the illustrated exemplary embodiments the flexible connecting element 15 is a Bowden cable, but differently configured flexible connecting elements 15 or even a rigid connecting element such as a rod can be used in principle.

Furthermore, the control element 10, 11, 12 is arranged in the region of the outer actuating lever 8. As a result, on the one hand, the control element 10, 11, 12 is accommodated and protected in the interior of the lock housing 3 and, furthermore, the control element 10, 11, 12 is arranged directly on the outer actuating lever 8, in order to be able to ensure the required blocking in normal operation and the release for emergency opening of the locking mechanism 1, 2 as described.

The invention claimed is:

1. A motor vehicle door lock comprising:

a locking mechanism having a rotary latch and a pawl, an actuating lever chain for opening the locking mechanism in an emergency, and a control element which blocks the actuating lever chain in normal operation and releases the actuating lever chain when the emergency occurs, wherein the control element has an electric motor and an output element;

wherein:

the control element further has a worm gear operated by the electric motor, and the output element meshes with the worm gear and has a blocking contour;

the actuating lever chain comprises an outer actuating lever and a coupling element that operatively couples the outer actuating lever to the locking mechanism, and the outer actuating lever has an abutment surface;

the output element is rotatable by interaction with the worm gear between a blocking position and a release position;

in the blocking position the blocking contour abuts directly against the abutment surface thereby interacting directly against the abutment surface to prevent movement of the outer actuating lever, and in the release position the blocking contour is disengaged from the abutment surface to permit movement of the outer actuating lever; and the output element is arranged in a plane below a plane of the outer actuating lever, and the blocking contour extends from the plane of the output element to the plane of the outer actuating lever for interacting against the abutment surface.

2. The motor vehicle door lock according to claim 1 further comprising a sensor, wherein the electric motor is activated as a function of signals from the sensor.

3. The motor vehicle door lock according to claim 2, wherein the sensor is configured to detect a crash.

4. The motor vehicle door lock according to claim 1, wherein the control element interacts directly with the outer actuating lever of the actuating lever chain.

5. The motor vehicle door lock according to claim 1 further comprising a flexible connecting element for coupling the actuating lever chain to a handle, wherein the control element interacts indirectly with the actuating lever chain and selectively blocks and releases the flexible connecting element.

6. The motor vehicle door lock according to claim 5, wherein the flexible connecting element is a Bowden cable.

7. The motor vehicle door lock according to claim 1 further comprising a lock housing, wherein the control element is arranged in an interior of the lock housing.

8. The motor vehicle door lock according to claim 1, wherein during the normal operation, the locking mechanism can only be opened by electric motor power.

9. The motor vehicle door lock according to claim 1, wherein the worm gear is rotatable in a plane that is parallel to a plane in which the outer actuating lever is rotatable.

10. The motor vehicle door lock according to claim 1, wherein the actuating lever chain is coupled mechanically to an outer door handle.

11. A motor vehicle door lock comprising:

a locking mechanism having a rotary latch and a pawl, an actuating lever chain for opening the locking mechanism in an emergency, and a control element which blocks the actuating lever chain in normal operation and releases the actuating lever chain when the emergency occurs, wherein the control element has an electric motor and an output element;

wherein:

the control element further has a worm gear operated by the electric motor, and the output element meshes with the worm gear and has a blocking contour;

the actuating lever chain comprises an outer actuating lever and a coupling element that operatively couples the outer actuating lever to the locking mechanism, and the outer actuating lever has a connector element that is articulated on an end of the actuating lever;

the output element is rotatable by interaction with the worm gear between a blocking position and a release position; and in the blocking position the blocking contour abuts directly against the connector element thereby interacting directly against the connector element to prevent movement of the outer actuating lever, and in the release position the blocking contour is disengaged from the connector element to permit movement of the outer actuating lever.

12. The motor vehicle lock according to claim 11, wherein the output element pivots the blocking contour about an axis of the output element to disengage the blocking contour from the connector element.

13. The motor vehicle door lock according to claim 11, further comprising a flexible connecting element for coupling the actuating lever chain to a handle, wherein the flexible connecting element is connected to the connector element.

14. The motor vehicle door lock according to claim 13, wherein the flexible connecting element is a Bowden cable.

15. The motor vehicle door lock according to claim 11, further comprising a lock housing, wherein the control element is arranged in an interior of the lock housing.

16. The motor vehicle door lock according to claim 11, further comprising a sensor, wherein the electric motor is activated as a function of signals from the sensor.

17. The motor vehicle door lock according to claim 16, wherein the sensor is configured to detect a crash.

18. The motor vehicle door lock according to claim 11, wherein during the normal operation, the locking mechanism can only be opened by electric motor power.

19. The motor vehicle door lock according to claim 11, wherein the worm gear is rotatable in a plane that is parallel in a plane in which the outer actuating lever is rotatable.

* * * * *